US007663977B1

(12) United States Patent
Hartelius

(10) Patent No.: US 7,663,977 B1
(45) Date of Patent: Feb. 16, 2010

(54) REMOVABLE TIMER CAP FOR LIQUID SOAP DISPENSER

(76) Inventor: Mark E. Hartelius, 8112 Komensky, Chicago, IL (US) 60652

( * ) Notice: Subject to any disclaimer, the term of this patent is extended or adjusted under 35 U.S.C. 154(b) by 147 days.

(21) Appl. No.: 11/710,179

(22) Filed: Feb. 23, 2007

Related U.S. Application Data

(60) Provisional application No. 60/834,690, filed on Aug. 2, 2006.

(51) Int. Cl.
*G04B 47/00* (2006.01)
*A24F 15/04* (2006.01)

(52) U.S. Cl. ..... 368/10; 221/24

(58) Field of Classification Search ..... 368/10, 368/107–110, 278, 204; 215/228, 230; 221/2, 221/15; 222/321.9
See application file for complete search history.

(56) References Cited

U.S. PATENT DOCUMENTS 6,084,504 A * 7/2000 Rosche et al. ..... 340/309.7
6,229,431 B1 * 5/2001 Weiner ..... 340/309.7
6,317,390 B1 * 11/2001 Cardoza ..... 368/10
6,667,936 B1 * 12/2003 Ditzig ..... 368/10
6,710,703 B2 * 3/2004 Huang ..... 340/309.16
6,832,916 B2 12/2004 Collopy
7,081,807 B2 * 7/2006 Lai ..... 340/309.7
7,362,660 B2 * 4/2008 Hildebrandt ..... 368/10
7,382,692 B1 * 6/2008 Hildebrandt ..... 368/10

* cited by examiner

*Primary Examiner*—Edwin A. Leon

(57) ABSTRACT

A timer assembly mounted removably on a personal soap dispenser of a type having a pump operated by a soap dispensing plunger with a handle and spout. The timer assembly has a housing capsule with a timer for measuring a preselected time interval; LEDs and a music generating chip for signaling the time interval to the user, and a pressure switch for starting the timer. The housing capsule is received in a flexible hood/cover mounted on the top of the handle so that pressure switch is actuated to start the time by pressure of the user's hand during depression of the handle to dispense soap.

7 Claims, 9 Drawing Sheets

REMOVABLE TIMER CAP FOR LIQUID SOAP DISPENSER

RELATED APPLICATION

Priority is claimed from provisional application 60/834,690 filed Aug. 2, 2006, the disclosure of which is incorporated herein by reference.

FIELD OF THE INVENTION

The invention relates to a timer assembly for mounting removably on a personal liquid soap dispenser

BACKGROUND OF THE INVENTION

Liquid soap dispensers incorporating timers to encourage users to wash their hands for a minimum time interval are known prior art.

An example of a hand operated version for personal use is taught by U.S. Pat. No. 6,832,916 issued Dec. 21, 2004 to Collopy, the disclosure of which is incorporated herein by reference. The prior personal soap dispenser comprises a bottle shape container having a top dispensing aperture mounting a manually depressable plunger of a hand operated pump. The plunger is a tube having a handle forming top from which a dispensing spout extends forwards at right angles. Manual depression of the plunger dispenses a predetermined amount of soap from the container through the spout.

However the timing mechanism of the prior dispenser relies on affecting the rate of return of the plunger to determine the time interval and is permanently incorporated therein, requiring a dedicated design. Furthermore, the prior dispenser does not provide eyecatching, illuminated visual or audible means signaling the time interval to the user.

SUMMARY OF THE INVENTION

It is an object of the invention to provide a timer assembly on a personal soap dispenser to encourage users to wash their hands for a minimum time interval which is removably mounted on the personal soap dispenser so that it can be transferred between dispensers for example from an emptied dispenser to another, full dispenser.

It is another object of the invention to provide a timer assembly which can readily be mounted by the consumer on a conventional personal soap dispenser after purchase.

It is an additional object of the invention to provide a timer assembly which comprises visual or audible means signaling the time interval to the user.

According to one aspect, the invention provides a timer assembly for mounting removably on a personal soap dispenser of a type having a pump operated by a soap dispensing plunger with a handle and spout, and comprising: a housing, a timer in the housing for measuring a preselected time interval; means in the housing for signaling the time interval to the user at least one of audibly and visually; actuating means in the housing for starting the timer; and means for mounting the housing on the handle, removably, so that the actuating means is normally operated to start the timer by depression of the handle to dispense soap.

In one example, the actuating means is a pressure switch and the housing caps the handle so that the switch is operated by pressure of the user's hand during depression of the handle to dispense soap.

Preferably, the timer assembly further comprises a battery, said signaling means comprises an LED and a sound generating chip and speaker operably connected to the timer and battery by an electrical circuit encapsulated by the housing.

It is also preferred that, the mounting means comprises a hood/cover formed with a housing receiving pocket having a resiliently flexible mouth portion and a spout receiving sleeve extending from the pocket whereby, when received in the pocket, the housing can be mounted removably on the handle by looping the sleeve over the spout and moving the assembly of the module and hood downwards and rearwards, away from the spout, bringing the mouth portion into gripping receipt of the handle. In practice, the mouth portion may require to be stretched by the user's fingers over the handle.

The timing device can be readily demounted by simply tilting forward towards the spout, stretching of the mouth portion to release at least a lower portion of the handle from the mouth portion and moving the assembly towards and over the spout to slip the sleeve off the spout. Again, the mouth portion may require to be stretched by the user's fingers to pass over the handle.

Finger engagable protuberances are formed on opposite sides of the mouth portion to facilitate manual stretching thereof.

The hood/cover may be made of rotocast vinyl.

Suitably, two LED flash and the sound generating chip generates a tuneful song for the duration of the time interval, which is approximately 20 seconds.

BRIEF DESCRIPTION OF THE DRAWINGS

In order that the invention may be readily understood, a specific embodiment thereof will now be described by way of example only and with reference to the accompanying drawings in which.

PARTICULAR DESCRIPTION

Figure 1:
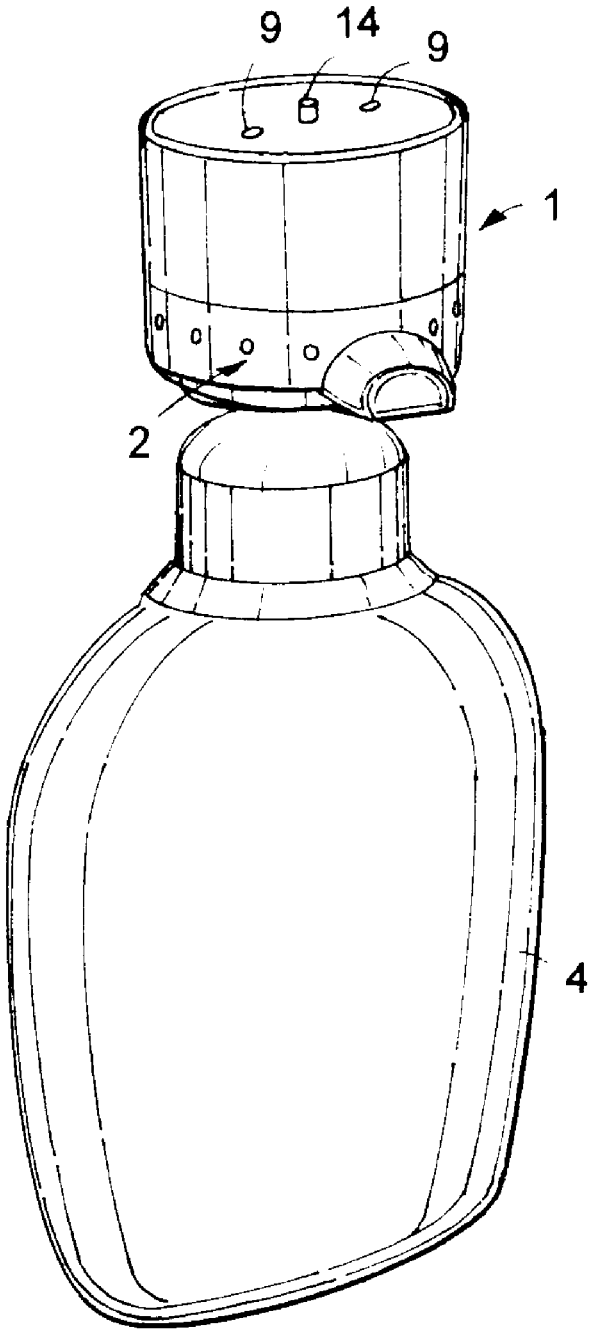
FIG. 1 is a perspective view from the front and above of a timer assembly mounted, removably on a pump plunger handle of a personal liquid soap dispenser.
Figure 2:
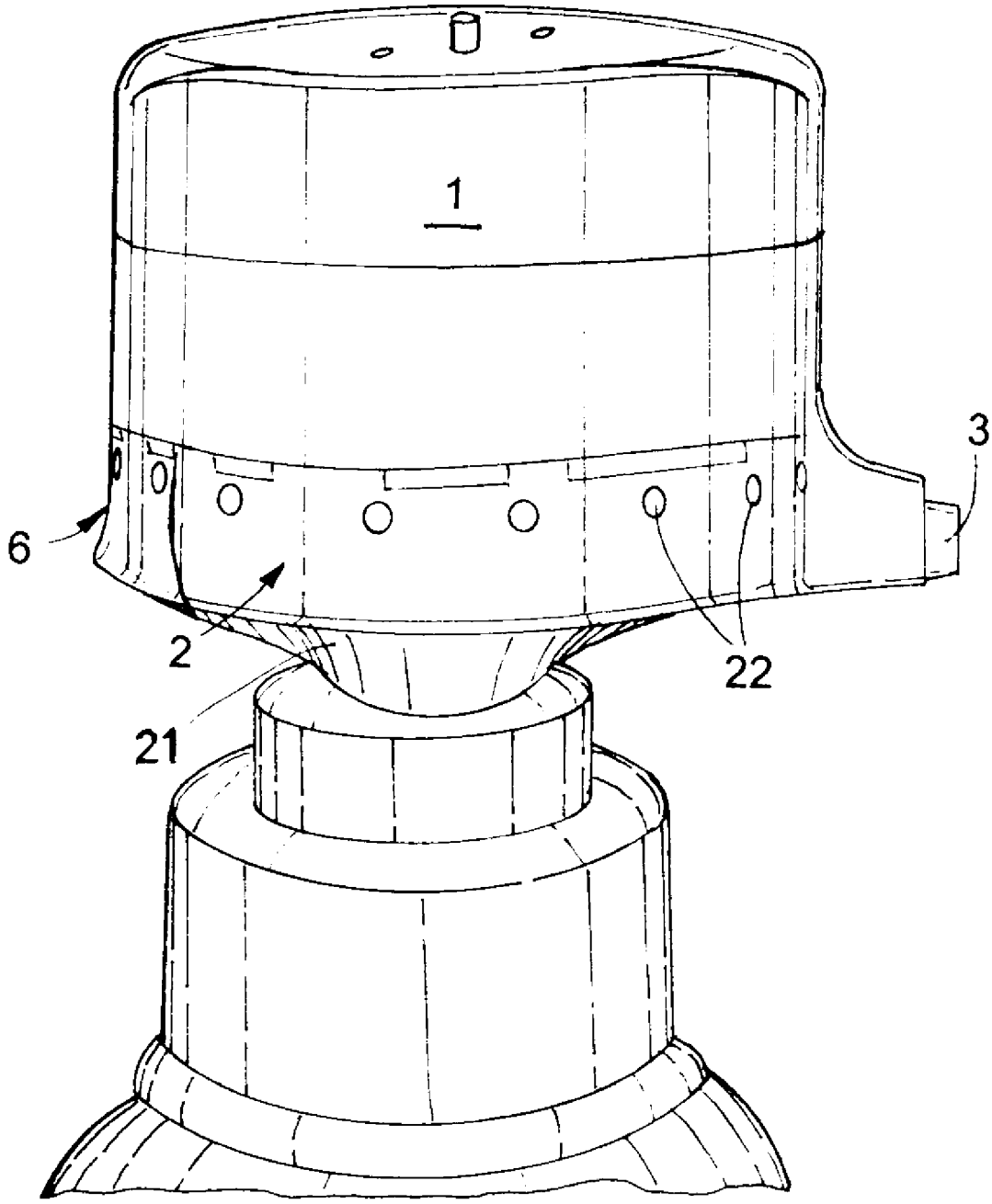
FIG. 2 is a side view of the of the timing assembly mounted on the pump plunger handle.
Figure 3:
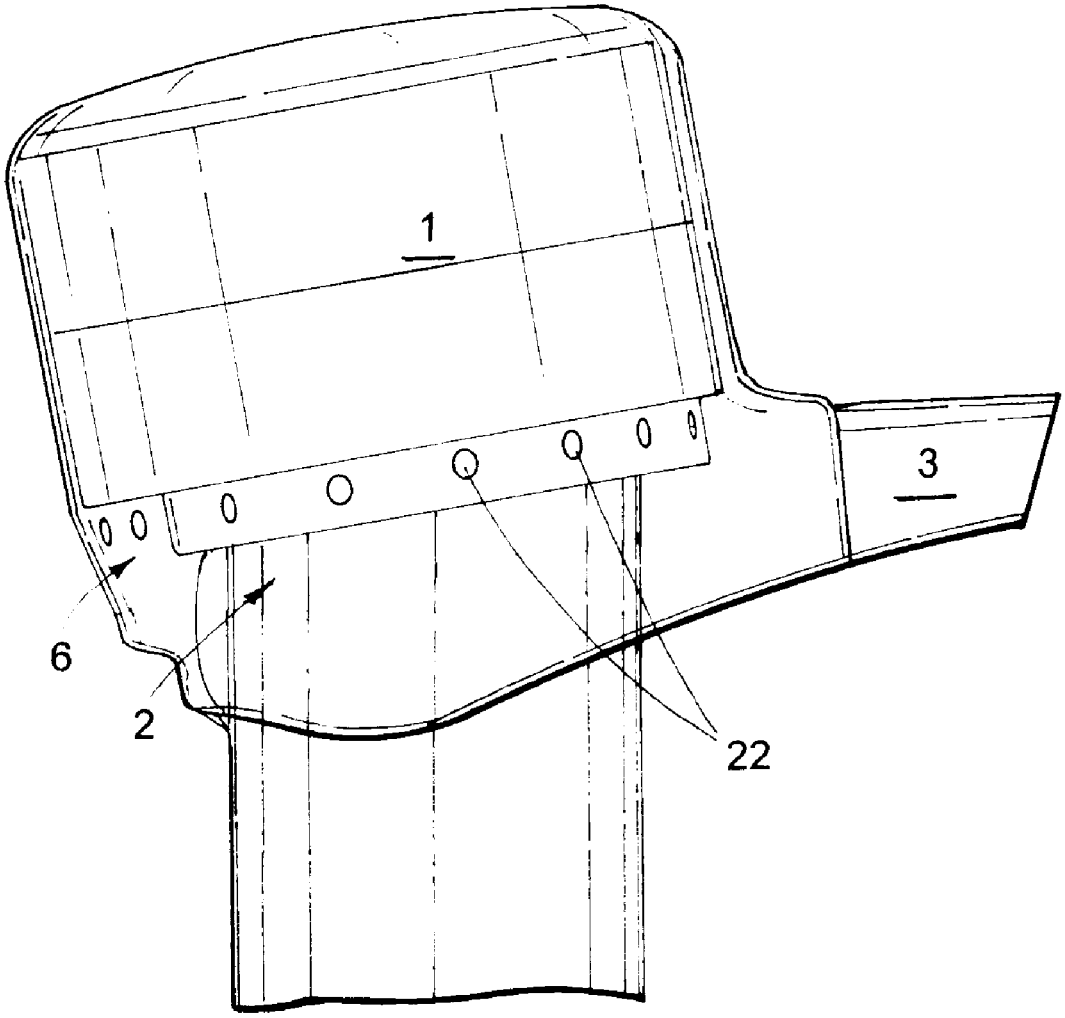
FIG. 3 is a side view of the of the timing assembly mounted on a pump plunger handle of another embodiment of personal liquid soap dispenser.
Figure 4:
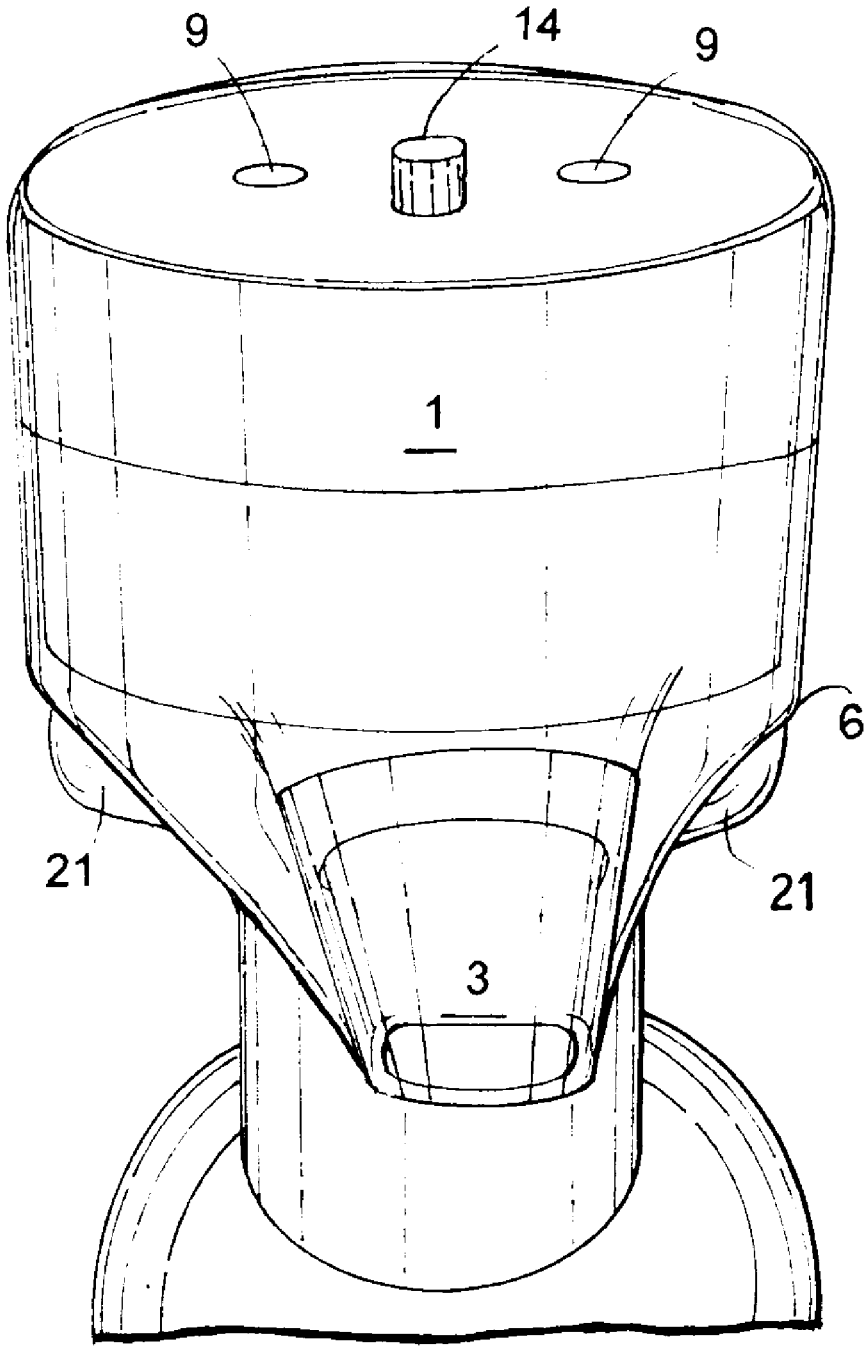
FIG. 4 is a perspective view from the front and above of the timer assembly mounted, removably on a pump plunger handle of FIG. 3.
Figure 5:
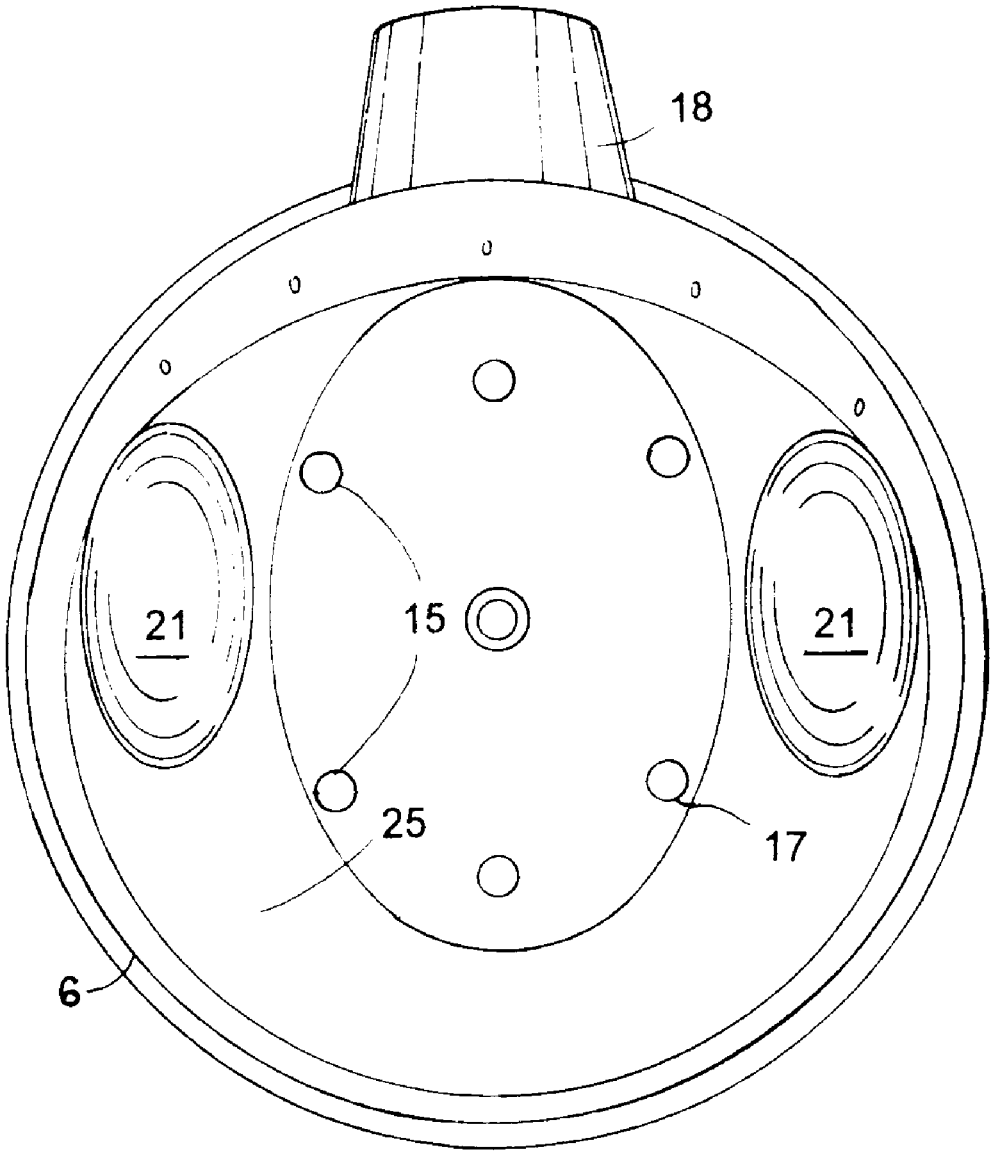
FIG. 5 is a bottom view of the timer assembly removed from the soap dispenser.
Figure 6:
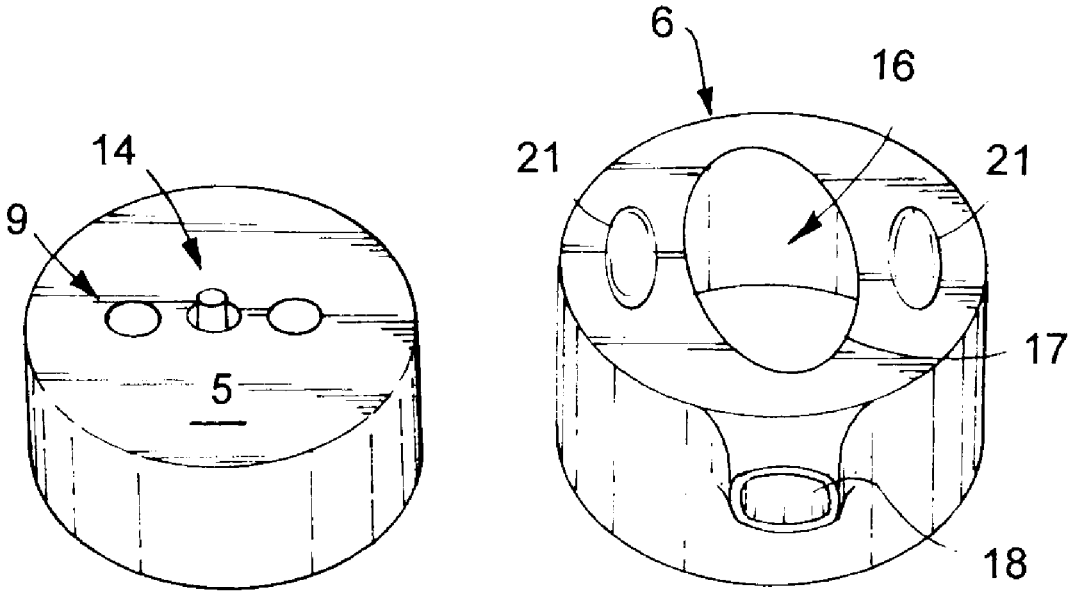
FIG. 6 is a perspective view of the top and side of a timer unit and the bottom and spout side of the hood/cover of the timer assembly device; and, FIGS. 7*a*-7*e* are top, side, bottom, rear and cross-sectional views along A-A of FIG. 1, respectively of the timer assembly; and, FIG. 8 is a bottom view of the timer unit with the hood/cover draw back to reveal the raised central area.

A timer assembly 1 is mounted removably on a pump handle 2 and spout 3 of a personal soap dispenser 4 which operates by depression of the handle to dispense liquid soap.

The timer assembly 1 comprises a timer unit 5 and a mounting hood/cover 6 which encloses the timer unit and handle to mount the timer unit removably thereon.

Figure 7E:
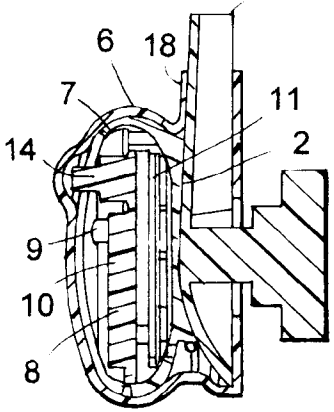
Figure 7C:
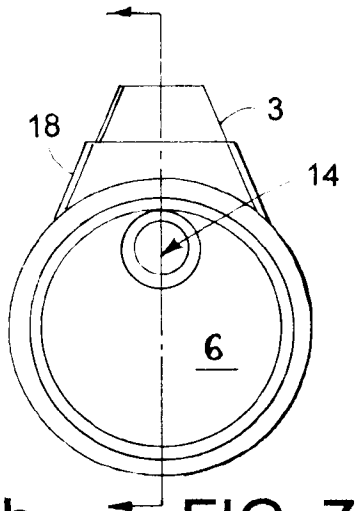
Figure 7D:
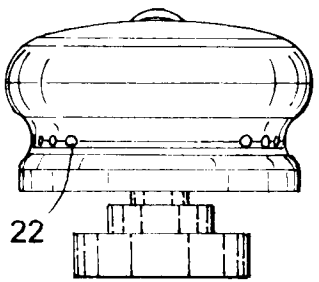
Figure 7B:
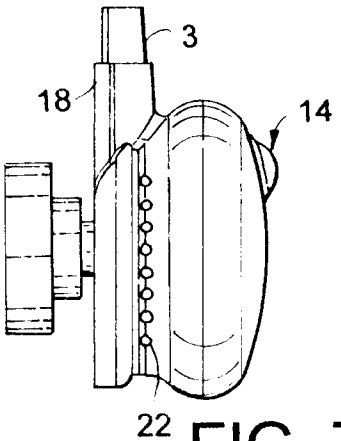
Figure 7A:
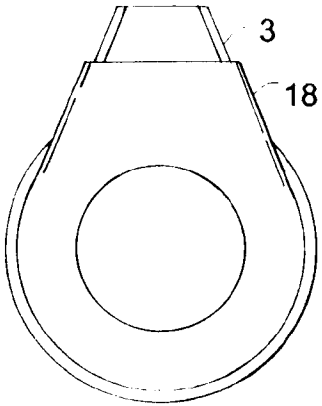
Figure 8:
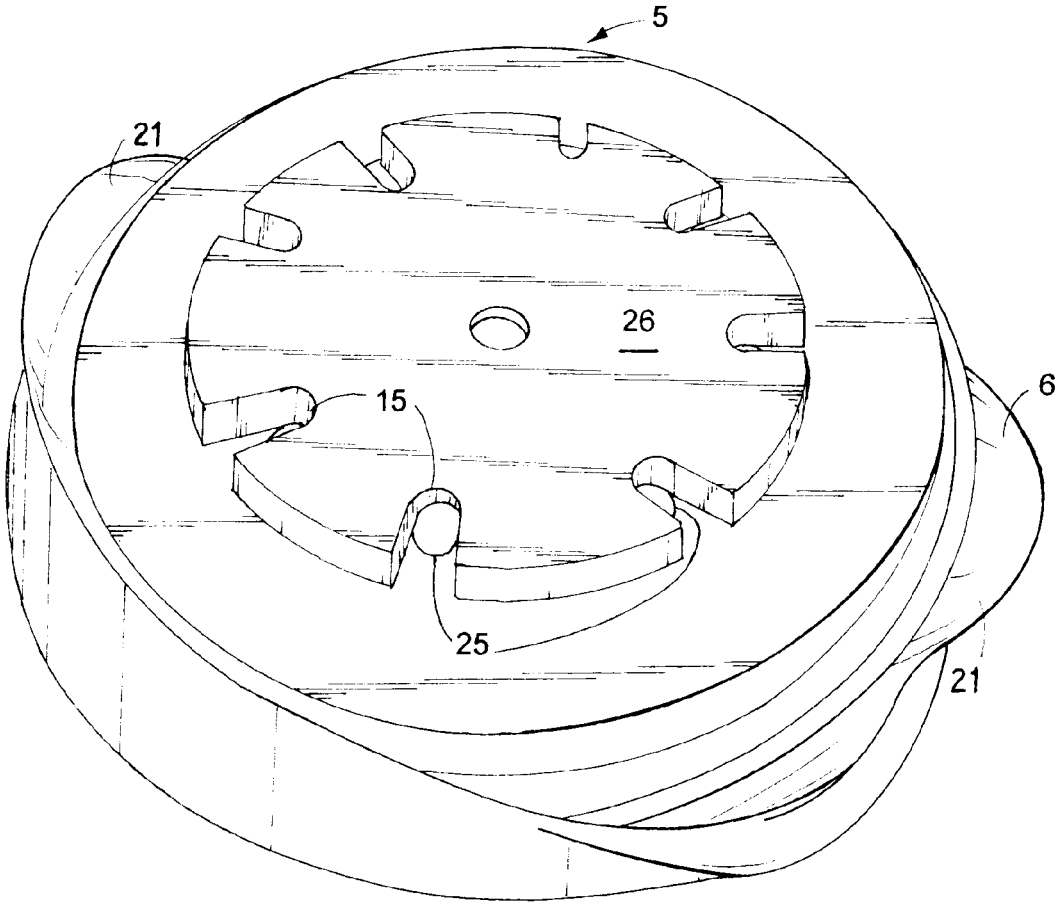
Figure 9:
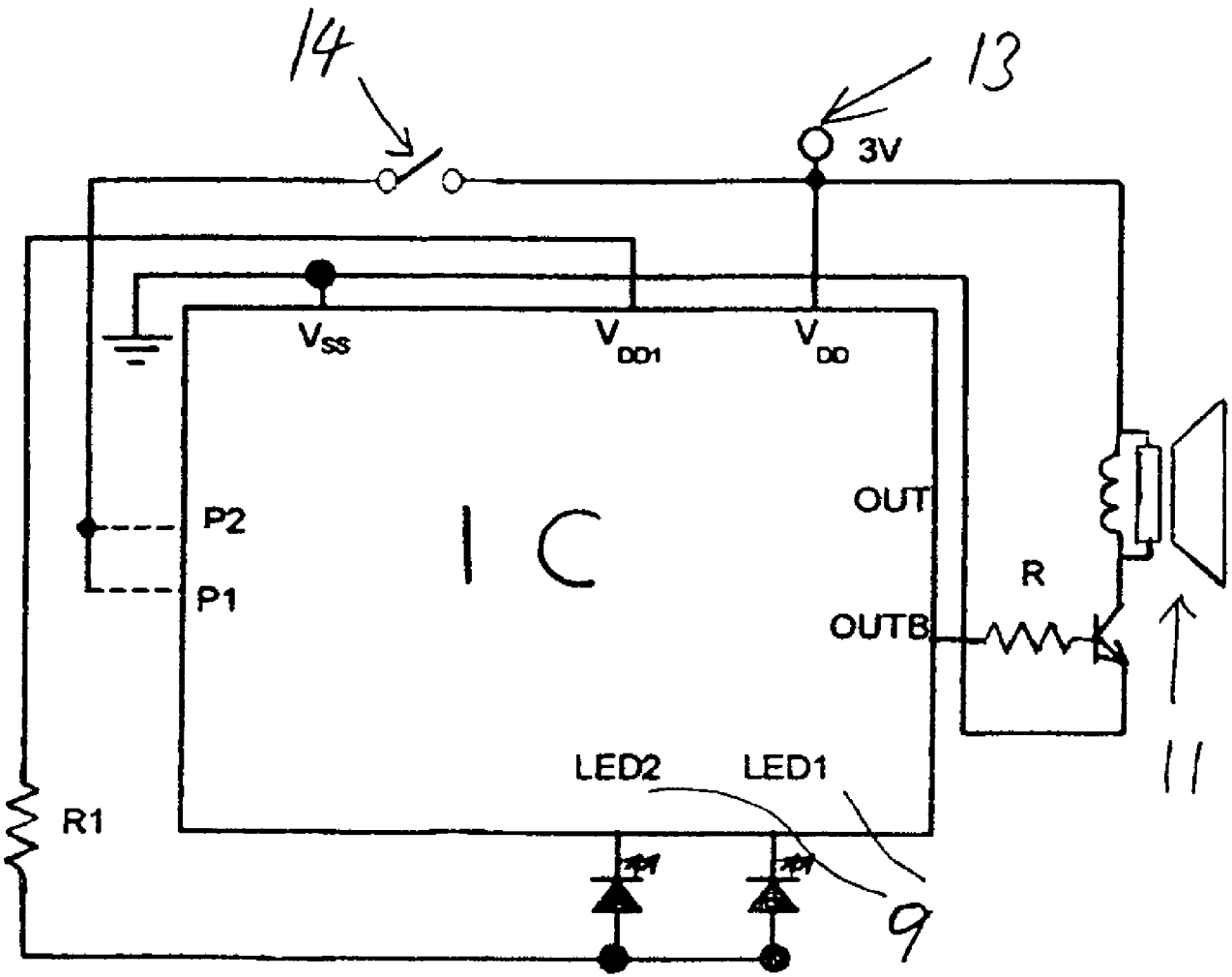
FIG. 9 is a schematic of the electrical circuit.

As shown in FIG. 7*c*, the timer unit comprises a bipartite rigid housing capsule of plastic 7, a timing chip IC 8 in the housing for measuring a preselected time interval, two LED 9 on top of the capsule, a sound generating circuit chip 10 and piezo electric speaker 11, and a battery 12 operably connected by a circuit board 13 to an actuating button 14 protruding above the top of the housing between the LED's. The bottom of the capsule has a raised central portion 26 formed with perforations 15 which communicate via respective slots 25 with the circumferential periphery of the raised portion 15 to permit the emission of sound.

In an alternative, the button does not protrude above the top of the housing but is contained wholly within the housing profile underlying a domed portion of the housing molded with reduced thickness for flexure to operably engage the button by manual depression.

The mounting hood/cover 6 is vinyl, rotocast to form a housing receiving pocket 16 having a resiliently flexible mouth portion 17 and a spout receiving sleeve 18 extending from the pocket 16. Finger-engagable dimples 21 are formed on opposite sides of the mouth portion and a series of sound releasing perforations 22 encircle a portion of the pocket wall which is clear of the capsule.

The timer unit/capsule assembly 1 is mounted removably on the handle 3 by insertion of the timer unit/capsule through the mouth portion 17 into the pocket 16, insertion of the spout 4 into the sleeve 18 and then moving the timer assembly rearward away from the spout and downwards, bringing the mouth portion into gripping receipt with the handle. In practice the mouth portion needs to be stretched by the user's fingers over the handle to engage thereunder.

The timer assembly can be readily demounted by simply tilting towards the spout with stretching of the mouth portion, aided by the fingers, to release at least a lower portion of the handle from the mouth of the hood and movement of the assembly towards and over the spout to slip the sleeve off the spout.

The invention claimed is:

1. A timer assembly for mounting removably on a personal soap dispenser of a type having a pump operated by a soap dispensing plunger with a handle and spout, the timer assembly comprising: a housing; a timer in the housing for measuring a preselected time interval; means in the housing for signaling the time interval to the user at least one of audibly and visually; actuating means in the housing for starting the timer; and means for mounting the housing on the handle, removably, so that the actuating means is normally operated to start the timer by depression of the handle to dispense soap wherein:

the mounting means comprises a hood/cover formed with a housing receiving pocket having a resiliently flexible mouth portion and a spout receiving sleeve extending from the pocket so that, when received in the pocket, the housing can be mounted removably on the handle by looping the sleeve over the spout and moving the assembly of the module and hood downwards and rearwards, away from the spout, bringing the mouth portion into gripping receipt of the handle and demounted by tilting forward towards the spout, stretching of the mouth portion to release at least a lower portion of the handle from the mouth portion and moving the assembly towards and over the spout to slip the sleeve off the spout.

2. A timer assembly according to claim 1 wherein the actuating means comprises a pressure switch and the housing caps the handle so that the pressure switch is operated by pressure of the user's hand during depression of the handle to dispense soap.

3. A timer assembly according to claim 1 wherein the timer assembly further comprises a battery, said signaling means comprises at least one LED and a sound generating chip and a speaker operably connected to the timer and battery by an electrical circuit encapsulated by the housing.

4. A timer assembly according to claim 3 wherein said at least one LED flashes and the sound generating chip generates a tuneful song for the duration of the time interval.

5. A timer assembly according to claim 3 wherein the time interval is 20 seconds.

6. A timer assembly according to claim 1 wherein finger engagable protuberances are formed on opposite sides of the mouth portion to facilitate manual stretching thereof during mounting on and demounting from the handle.

7. A timer assembly according to claim 1 wherein the hood/cover is made from elastic material.

* * * * *